United States Patent [19]

Oboler

[11] Patent Number: 4,625,484

[45] Date of Patent: Dec. 2, 1986

[54] STRUCTURAL SYSTEMS AND COMPONENTS

[75] Inventor: Leonard Oboler, Key Biscayne, Fla.

[73] Assignee: High Tech Homes, Inc., Miami, Fla.

[21] Appl. No.: 751,808

[22] Filed: Jul. 5, 1985

[51] Int. Cl.[4] ..... E04B 1/00

[52] U.S. Cl. ..... 52/251; 52/309.12; 52/91; 52/437; 52/600

[58] Field of Search ..... 52/251, 250, 259, 309.12, 52/90, 91, 437, 438

[56] References Cited

U.S. PATENT DOCUMENTS

| | | | |
|---|---|---|---|
| 2,744,042 | 6/1951 | Pace | 154/75 |
| 2,851,873 | 9/1958 | Wheeler-Nicholson | 52/438 X |
| 3,310,917 | 3/1967 | Simon | 52/90 |
| 3,315,424 | 4/1967 | Smith | 52/206 |
| 3,398,491 | 8/1968 | Babcock | 52/90 |
| 3,446,692 | 5/1969 | Turnbull | 161/69 |
| 3,458,609 | 7/1969 | Smith et al. | 264/46 |
| 3,677,874 | 7/1972 | Sterrett et al. | 161/116 |
| 3,803,788 | 4/1974 | Artmann | 52/438 X |
| 3,874,139 | 4/1975 | Landwoski | 52/438 X |
| 3,879,908 | 4/1975 | Weismann | 52/309 |
| 4,006,570 | 2/1977 | Stolz | 52/438 X |
| 4,015,387 | 4/1977 | Tillie | 52/437 X |
| 4,038,798 | 8/1977 | Sachs | 52/309 |
| 4,047,357 | 9/1977 | Mulholland et al. | 52/90 |
| 4,071,984 | 2/1978 | Larrow | 52/79.1 |
| 4,079,560 | 3/1978 | Weismann | 52/309 |
| 4,090,340 | 5/1978 | Becker | 52/618 |
| 4,140,824 | 2/1979 | Gaillard | 428/81 |
| 4,187,651 | 2/1980 | Tolsma | 52/79.1 |
| 4,226,067 | 10/1980 | Artzer | 52/309 |
| 4,236,361 | 12/1980 | Boden | 52/204 |
| 4,249,354 | 2/1981 | Wynn | 52/309.12 X |
| 4,250,670 | 2/1981 | Garner | 52/92 |
| 4,253,288 | 3/1981 | Chun | 52/454 |
| 4,288,962 | 9/1981 | Kavannaugh | 52/743 |
| 4,297,820 | 11/1981 | Artzer | 52/309.11 |
| 4,336,676 | 6/1982 | Artzer | 52/309.7 |
| 4,340,802 | 7/1982 | Artzer | 219/56 |
| 4,342,180 | 8/1982 | Gibson et al. | 52/741 |
| 4,393,636 | 7/1983 | Rockstead et al. | 52/91 X |
| 4,454,702 | 6/1984 | Bonilla-Lugo et al. | 52/745 |
| 4,455,793 | 6/1984 | Nania | 52/91 |
| 4,486,993 | 12/1984 | Graham et al. | 52/262 |
| 4,486,996 | 12/1984 | Alejos | 52/309 |
| 4,489,530 | 12/1984 | Chang | 52/741 |
| 4,505,019 | 3/1985 | Deinzer | 29/432 |

*Primary Examiner*—Carl D. Friedman

*Attorney, Agent, or Firm*—Richard P. Matthews

[57] ABSTRACT

A structural system and components for housing or other structures and their methods of production. Panel members serve as structural elements or as filler members or both, and in some applications can be removed. The panel members are provided with mesh on one or both sides of a heat insulation core member with the mesh being welded or otherwise affixed to I-beams or reinforced concrete reinforcing steel to form a continuous structural solution. Roof panels are provided which are similar to that of the vertical walls, and the mesh on the upper surface is firmly affixed to both the columns and the reinforced concrete perimeter beam, affording a finished structure of great structural integrity. In all cases, the panels allow pouring of concrete around previously installed, reinforcing steel, allowing a final reinforced concrete structure similar to that constructed conventionally, but eliminating the extensive forming labor connected therewith.

16 Claims, 18 Drawing Figures

FIG. 1
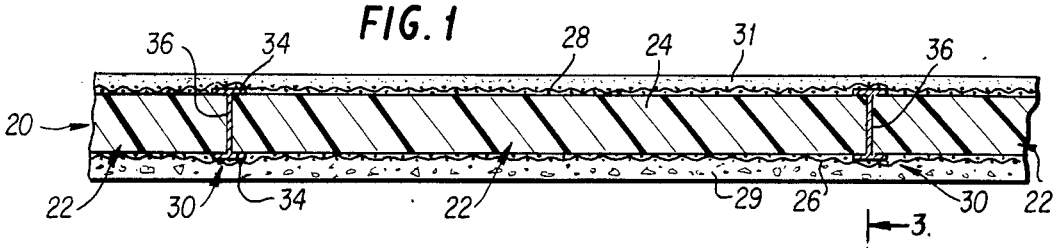
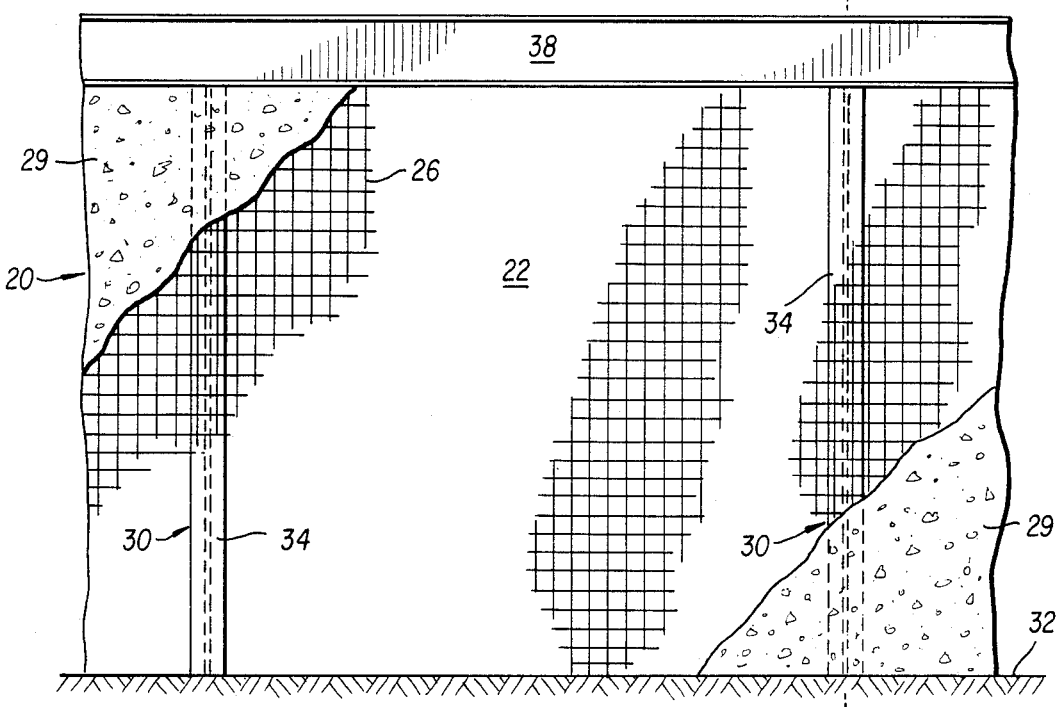
FIG. 2
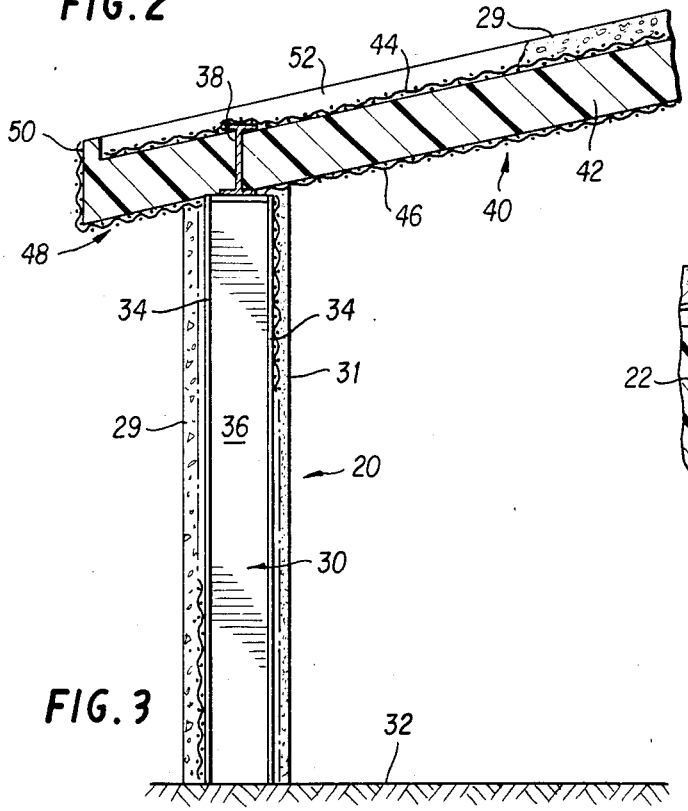
FIG. 3
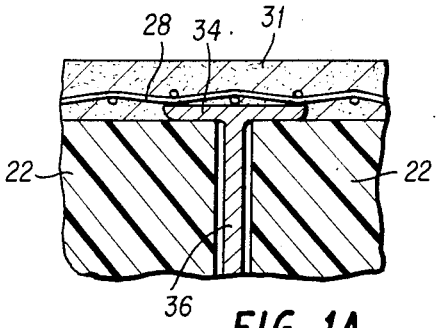
FIG. 1A

STRUCTURAL SYSTEMS AND COMPONENTS

This invention relates to structural systems formed by prefabricated components used in the manufacture of homes, buildings and other structures and, more particularly, to the eclectic combination of lightweight panel members, load bearing members and reinforcing members in achieving structural rigidity.

BACKGROUND OF THE INVENTION

With increasing emphasis on the need to provide low cost energy efficient housing and buildings, utilization of expanded plastic material and panels for insulation is becoming more prevalent. Such plastic materials are generally applied to conventional construction, or prefabricated in the form of lightweight composite panels applied to conventional on-site or prefabricated structures, thereby generally increasing somewhat the cost of such construction.

Referring to conventional multifloor structures, these generally incorporate prefabricated panel elements as enclosure material or sheathing, the structure itself being erected in situ using standard structural sections or forming and pouring concrete around reinforcing steel to form reinforced concrete structural elements.

Prefabricated expanded plastic material is also presently used as a filler between sheet metal surfaces, plane or corrugated, affixed to opposing sides of the plastic. Although this solution provides, if properly installed, both required rigidity and thermal properties, it is not particularly applicable to residential construction. The general use of the prefabricated plastic panel or sheet is therefore presently confined to thermal applications and reduction of energy costs, and has done little or nothing to lower initial construction costs. Conventional structural costs may even be increased as a result of accommodating these prefabricated elements to achieve thermal energy savings.

SUMMARY OF THE INVENTION

The foregoing problems and shortcomings of the prior art have been carefully considered and effectively solved in accordance with the present invention. A site is prepared and a grade beam constructed. The top of the grade beam is finished to floor level. At intervals, reinforcing rods are anchored to foundations poured integrally with the grade beam. Alternately, plastic or steel I-beam columns may be erected and anchored to the foundations.

A plurality of prefabricated panels are then assembled at the job site. These panels are manufactured so as to be lightweight for easy handling, and of dimensions such as to form standard building wall and roof components for any selected type structure. Panels will be composed of an expanded plastic material, such as polystyrene, polyurethane, or similar material, and may contain fire retardant chemicals if required. Each panel may be delivered as one piece, or several pieces joined together on site to achieve any required dimension. Joining the panels may be achieved by gluing or or bonding together, or pins and splines may be used, separately or in conjunction with the bonding process. Panels may contain a mesh of plastic or metal affixed to one or both sides, or such mesh may be applied following erection on site.

Each wall panel will contain edge contours which will surround the previously located reinforcing steel, or steel or plastic I-beams, allowing columns to form an integral structure together with the panels following pneumatic or manual application of the concrete or plaster later applied to the panel surfaces. The concrete or plaster will also incorporate a mesh, which if used, is firmly affixed to the reinforcing steel or to the flanges of the plastic or steel I-beams.

Following setting of the applied or poured concrete, the panel wall units revert to insulation members only, and may even be removed, leaving in place reinforced concrete columns at intervals equivalent to the width of the plastic panels.

The reinforcing mesh may be affixed to one, two or no sides of each panel, and mesh placed on both sides of any panel may be joined by wire inserted through any panel prior to application of the concrete and/or plaster wall covering.

Prefabricated intermediate floor panels or roof sections are assembled and placed similarly to and following erection of the wall panels. In each case, a perimeter beam is poured together with the floor or roof concrete covering. This covering is applied following erection, and a steel mesh is included over the entire roof or floor section, which mesh is first tied or welded to both the column reinforcing steel and to the perimeter beam reinforcing steel so as to achieve a complete reinforced concrete structure which firmly joins all elements together. In the case of the steel beam column, this column must also be firmly fastened to the mesh as well as to the perimeter reinforcing steel so as to achieve the same result.

The intermediate floor panels will have beams at intervals, which beams will be perpendicular to the perimeter beam, and the steel for which is joined to the perimeter beam steel prior to pouring of the concrete. As is the case with the wall panels, following curing of the concrete, the plastic will revert to a sound and thermal insulator only, and the reinforced concrete beams and slab will absorb any applied loading. The plastic underside will also serve as a flat surface to which ceiling finish of the lower floor may be applied. Curved shapes and other contours may also be used, if required, on the underside of the intermediate floor panels.

Roof panels will be assembled and installed similarly to the intermediate floor panels, except that the longitudinal beams perpendicular to the perimeter beams may not be required, dependent upon the selected span. The roof panels will include, however, a cut-out on either side so as to enable pouring and joining the upper portion of each lateral column with the perimeter beam, following joining of all reinforcing steel and mesh required for completing the structure.

For roof panels, the plastic material will be utilized not only as a form to enable the pouring of the roof slab, but also as a structural component composite section formed by reinforced concrete on top, and expanded plastic below. For long spans, a third tensile member may be incorporated, such a member being a mesh incorporated into the bottom of the plastic material, or applied to and firmly affixed to or near the underside of the plastic material. This tensile member may also be a fiberglass mat affixed to the underside of the expanded plastic.

The entire plastic panel erection may be accomplished prior to pouring or placing any concrete, or the assembly of the building may be phased, depending upon the geometry of the completed structure.

The concrete may be poured or placed pneumatically, and all columns and beams covered, once joining of the mesh elements and reinforcing steel has been completed. A combination of pouring of certain areas and manual or pneumatic concrete placement of others may also be accomplished. For pneumatic placement and completing of structural elements, gunite or Shotcrete may be used. Gunite and Shotcrete are two processes for pneumatically applying high density, low water concrete which cures to a very high strength such as from 5,000 to 8,000 PSI.

The process allows completion of a structure with a minimum of labor intensive formwork, and will result in a great economy in construction. In addition, the thermal and acoustic properties of the plastic panels will result in an energy efficient, sound proof and low cost construction solution.

Electrical, plumbing, and HVAC (i.e., heating, ventilating and air conditioning) problems are also easily accommodated by the process. Channels and ducts may be molded into the panels prior to erection, or cut into the plastic following erection. These services may also be partially accommodated in the floor slab which may be poured following building erection.

The HVAC ducting may be installed in the eave overhang of the roof panels so as not to interfere with the structural characteristics of the composite roof panel, and connected to the interior of the strucutre via openings left or cut into the wall panels between the columns and beneath the perimeter beam formed into the roof panels.

The inherent advantages and improvements of the present invention will become more readily apparent upon reference to the following detailed description of the invention and by reference to the drawings wherein:

DRAWINGS

FIG. 1 is a fragmentary top plan view of a wall structure made in accordance with the present invention, taken in horizontal cross section;

FIG. 1*a* is a fragmentary elevational view, drawn to an enlarged scale, showing a detail of FIG. 1;

FIG. 2 is a front elevational view of the wall structure of FIG. 1;

FIG. 3 is an elevational view taken in vertical cross section along the line 3—3 of FIG. 2;

Figure 15:
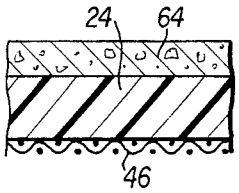
Figure 16:
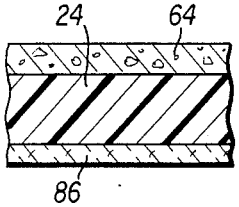
Figure 12:
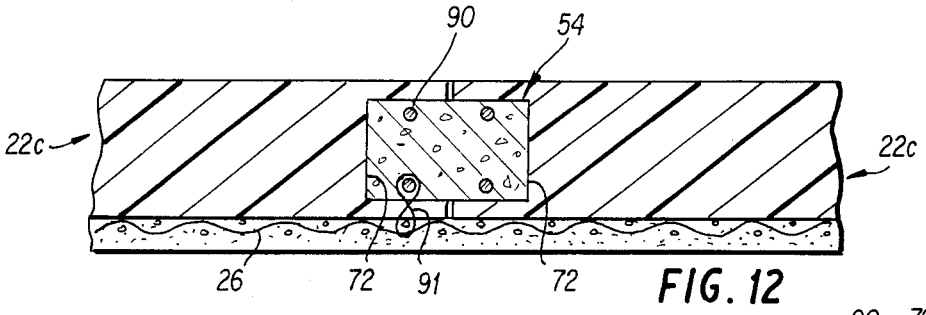
FIG. 12 is a fragmentary plan view taken in horizontal cross section of a further embodiment of the invention.
Figure 12A:
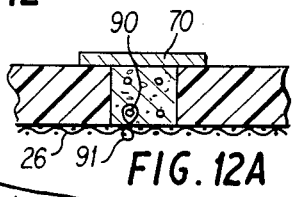
Figure 13:
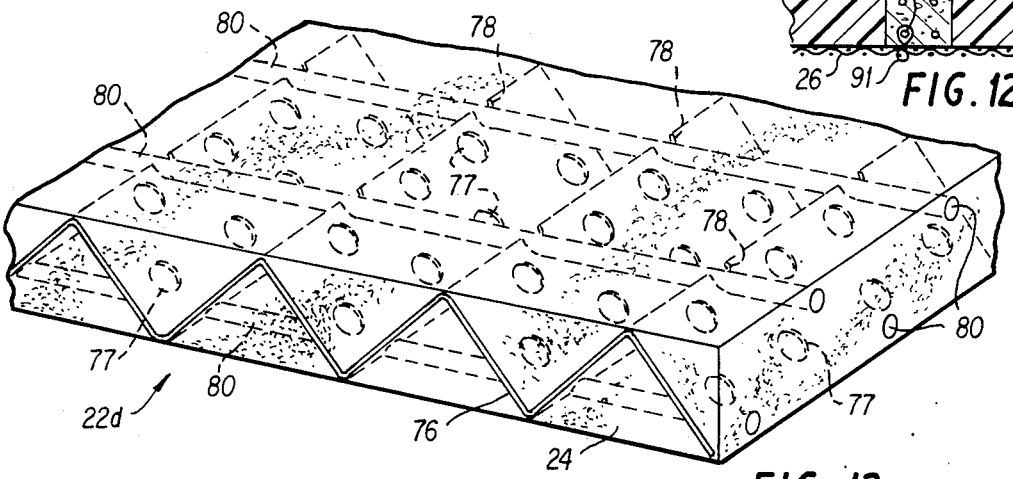
Figure 14:
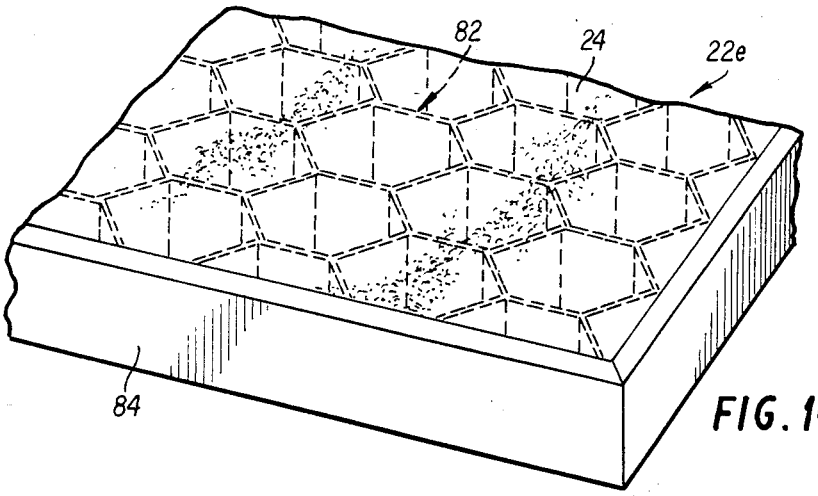

FIG. 12*a* is a fragmentary plan view, taken in horizontal cross section, of another embodiment of the invention;

FIG. 13 is a fragmentary perspective view illustrating another form of panel construction;

FIG. 14 is a fragmentary perspective view illustrating still another form of panel construction;

FIG. 15 is a fragmentary elevational view taken in vertical cross section of one embodiment of a roof panel material; and FIG. 16 is a fragmentary elevational view taken in vertical cross section of another embodiment of a roof panel material.

DETAILED DESCRIPTION OF THE INVENTION

Referring now to FIG. 1 of the drawings, there is illustrated a wall section, indicated generally at 20, for a building structure. FIG. 1 illustrates individual panel members by the general designation 22 each of which is provided with a plastic core 24, an optional outer wall mesh member 26 plus an optional inner wall mesh member 28. Mesh members 26, 28 may be fixedly secured to each other through the plastic core 24 or hung on the plastic core 24 by suitable hooks, not shown, and are also optionally secured to the I-beam flanges by welding or other means. Following erection and placement of the mesh, a concrete 29 or plastic 31 or other coating is applied manually or pneumatically to the mesh covered surfaces of the panel as seen in FIG. 1*a*. These materials bond firmly to the plastic material and to the mesh, allowing then a structural member of great strength to be formed.

Vertically disposed I-beams are indicated generally at 30 thereby providing a vertical column. These I-beams 30 are preferably regularly spaced along wall section 20. The I-beams are secured to a suitable foundation or concrete slab 32 in conventional manner. The I-beams themselves include end flange members 34 which separate optional adjacent mesh members 26 from and along the outer wall and adjacent optional mesh members 28 from and along the inner walls. This lifting of the mesh away from the wall places the mesh 26 and 28 in the best position for reinforcing the coatings to be applied to the surfaces. A central or interconnecting web member 36 carries the end flange members.

As can be seen in both FIGS. 2 and 3, a horizontally disposed I-beam 38 is affixed to the columnar I-beams 30 in the plane of wall section 20 and on top of a plate member along the upper wall of the wall section. The columnar I-beams 30 and the horizontal I-beams 38 may be metallic, but could also be made of fiberglass, concrete, or wood in any combination. Alternately, the I-beams could be replaced by square or rectangular wooden or plastic or metallic building shapes.

FIG. 3 also illustrates a roof panel member indicated generally at 40. Roof panel member 40 is provided with a central plastic core 42, an upper or outer mesh member 44 and an optional lower or inner mesh member 46. A truncated optional panel member indicated generally at 48 provides an overhang for the roof. The truncated panel member 48 may be provided with an upstanding or elevated end lip member 50 and elevated side lip members 52 with these lip members provided on at least three sides of the roof structure so as to provide restraining means for a layer of concrete which is poured atop the upper surface of the roof panel member 40. While roof panel member 40 is generally provided with straight sides, it may be tapered as in the roof panel members illustrated in FIG. 5. Thus, it will be seen that the roof panel members may taper inwardly as the panel structure approaches an apex of the roof structure.

Figure 5:
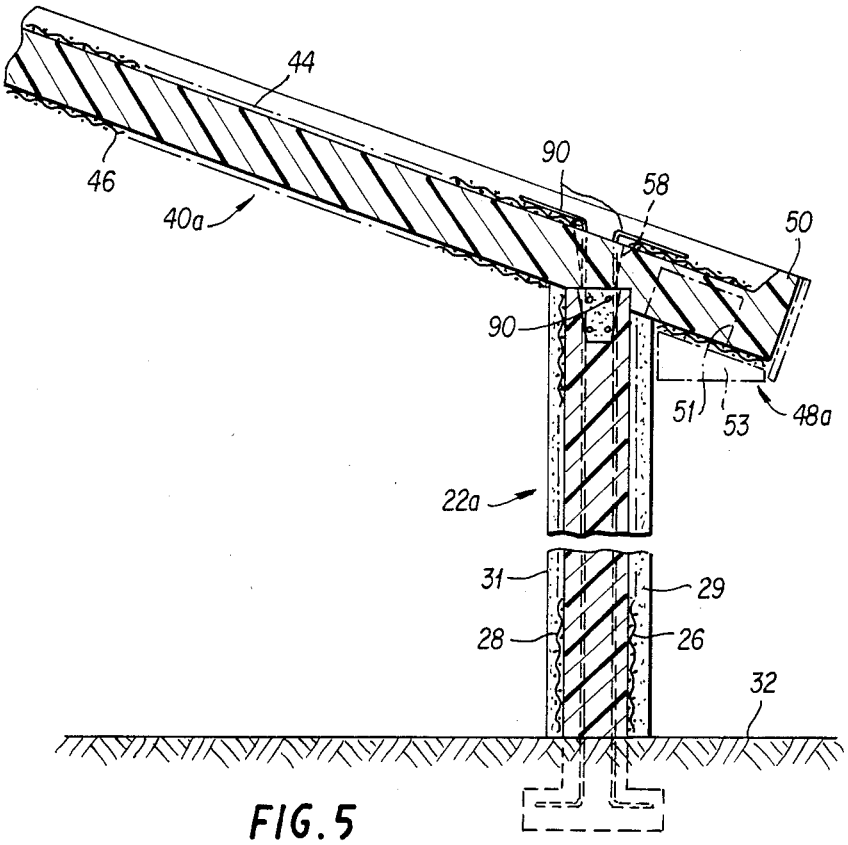
FIG. 5 is an elevational view taken in vertical cross section along line 5—5 of FIG. 4.
Figure 4:
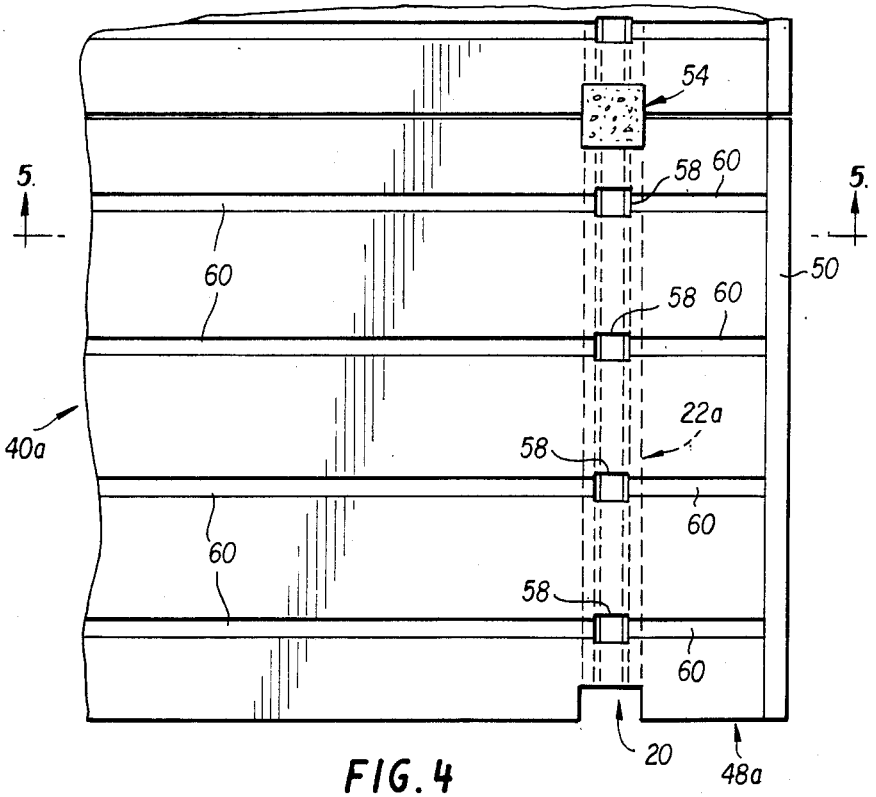
FIG. 4 is a fragmentary top plan view of another embodiment of the present invention.
Figure 7:
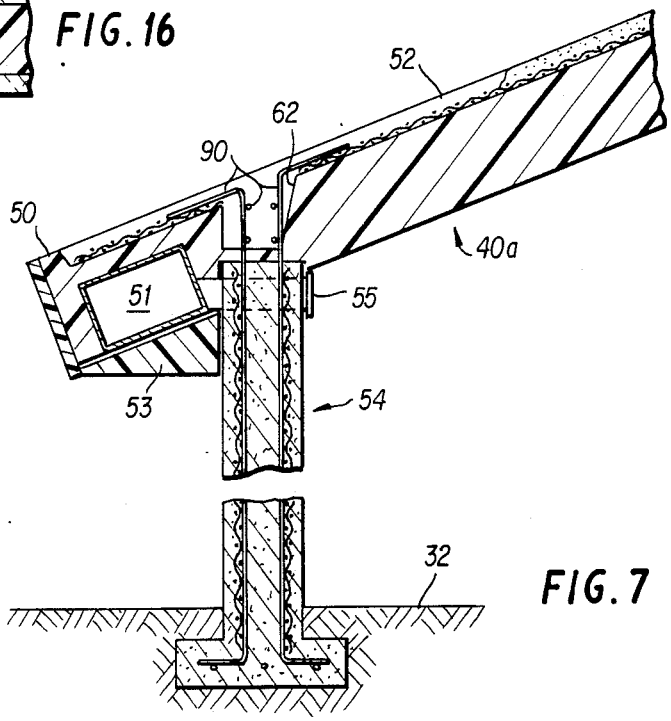
FIG. 7 is a fragmentary elevational view illustrating another embodiment of the present invention and taken in vertical cross section.

FIGS. 4 and 5 illustrate a modified form of the individual panel members and is designated 22*a* in FIG. 5. In FIG. 4 a reinforced concrete column member is indicated generally at 54 which is in the plane of wall section 20. The panel member 22*a* is provided with a longitudinally extending groove 56 so as to receive reinforced concrete therein. The reinforced concrete in groove 56 establishes a perimeter beam for the structure extending around the four sides thereof. The pouring of the concrete on an in situ basis is effected prior to placement of the roof panel members 40*a*, or following placement of the roof panel members 40*a*, with the aid of a plurality of apertures 58 which provide conduits for the concrete that provides a layer thereof atop the roof panel members designated 40*a* in FIGS. 4 and 5. These apertures 58 extend entirely through the roof panel members 40*a*. Optionally, the panel members 40*a* may be provided with an air conditioning duct 51 and an optional soffit member 53. FIG. 7 also shows an air conditioning duct 51, soffit member 53 and a grill member 55. With the ducts for heating, ventilating and air conditioning located outside the enclosed perimeter of the house, these ducts may be brought into communication with the inside of the house by openings cut through the perimeter walls.

Figure 8:
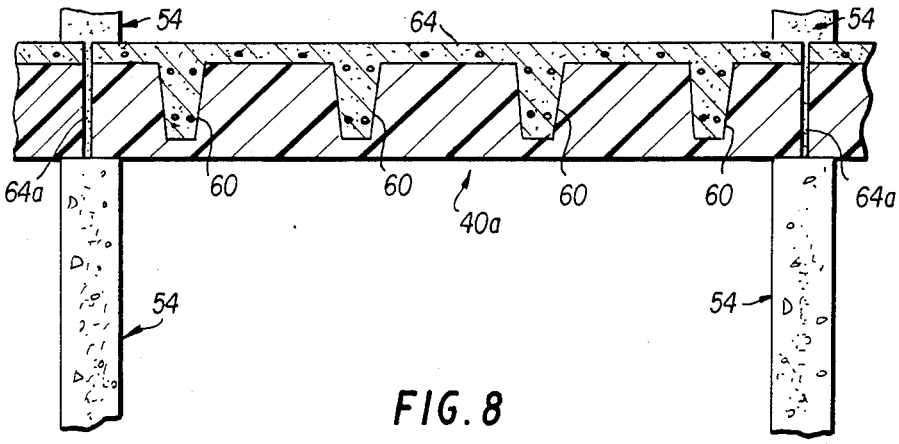
FIG. 8 is an elevational view taken in vertical cross section illustrating a variant for multifloor construction of the embodiment of FIG. 7.
Figure 9:
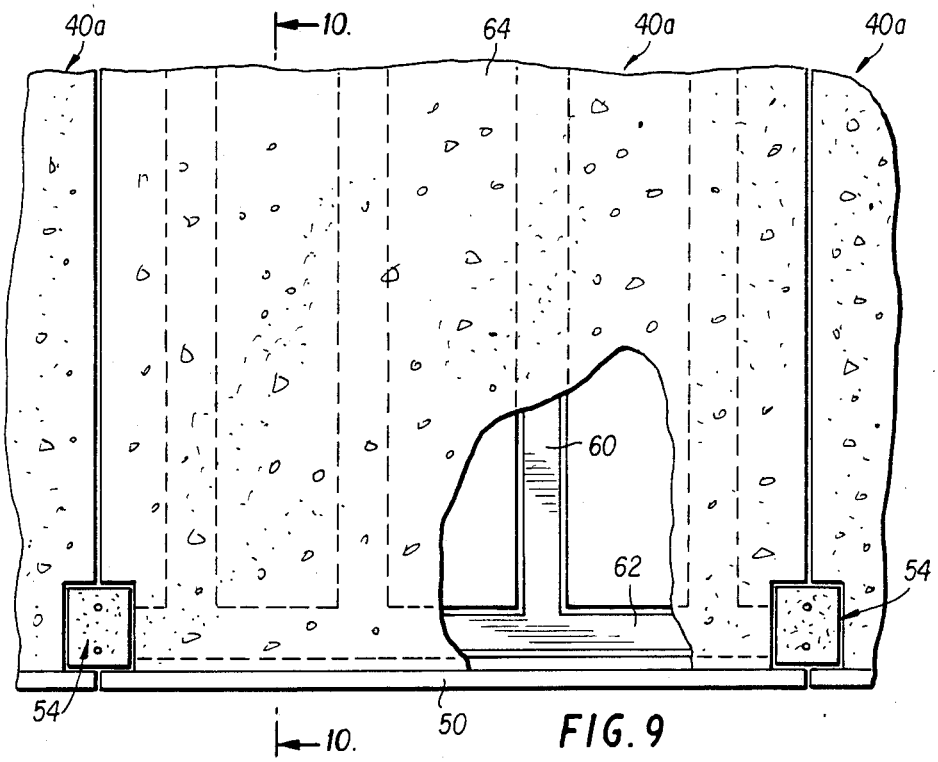
FIG. 9 is a top plan view of the construction of FIG. 8 with portions broken away.
Figure 10:
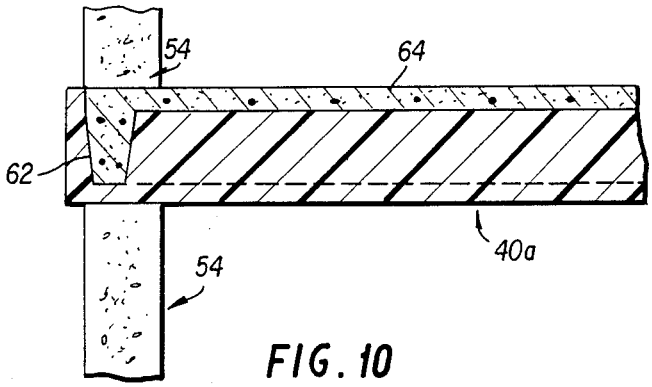
FIG. 10 is an elevational view taken in vertical cross section along the line 10—10 of FIG. 9.

As can also be seen in FIGS. 4, 8 and 9, roof members 48*a* and intermediate floor panel members 40*a* may be also provided with longitudinally extending channels 60 to receive reinforced concrete therein. For relatively short spans, the channel 60 is not required, the concrete and the plastic forming a composite beam. Additionally, as will be observed in FIGS. 9 and 10, at least one laterally extending conduit 62 is provided in fluid communication with the longitudinally extending channel means 60, and the columns 54, and is poured together with the extension of the reinforced column 54, joining together the entire structure. Preferably, a laterally extending conduit such as is illustrated at 62 is provided at opposite ends of the roof panel member 40*a*. While the reinforced conduit itself is not illustrated in FIGS. 4 and 5, it is illustrated in FIGS. 8–10 at 64.

Figure 6:
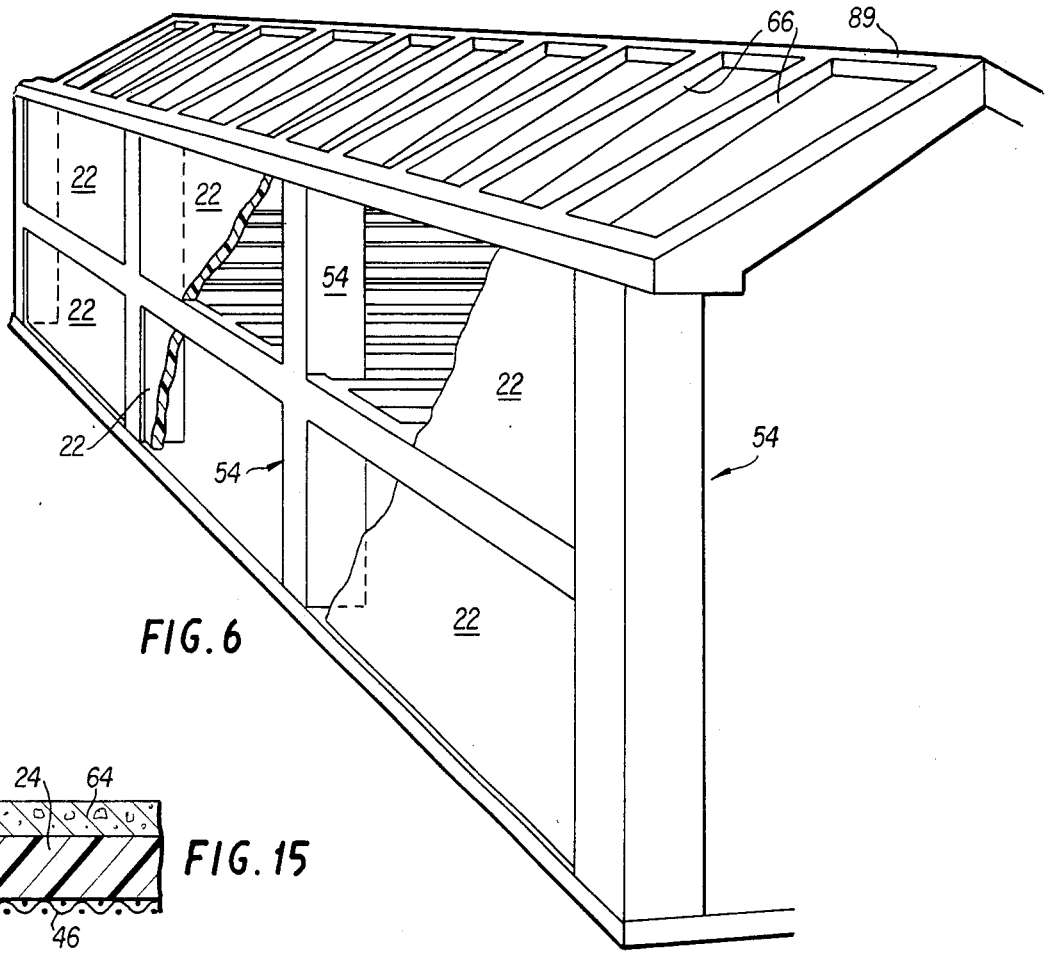
FIG. 6 is a fragmentary perspective view of a building made in accordance with the present invention taken partially in cross section and with portions broken away and all roof and intermediate floor plastic removed.

Reference to FIG. 6 illustrates a typical building manufactured in accordance with the present invention. As is illustrated, the invention is applicable to multistory buildings as well as to single story buildings. This figure illustrates the general relationship between the reinforced concrete column members 54 and the reception of individual panel members 22 therebetween. The building illustrates optional tapered rafters 66 with the roof panel members removed for purposes of clarity. The tapered rafters are not required for short spans, and, if employed, may be tapered or parallel sided. The specific construction for the peak of the building is not critical insofar as the present invention is concerned and may be effected in any conventional manner, with or without a reinforced concrete ridge beam 89.

Figure 11:
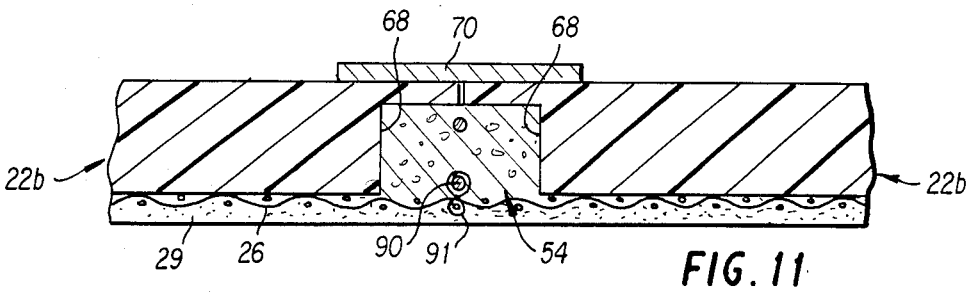
FIG. 11 is a fragmentary plan view taken in horizontal cross section of another embodiment of the invention.

Referring now to FIGS. 11 and 12, there are illustrated two methods of forming the concrete column members 54. In the FIG. 11 embodiment, two molded panel members 22*b* having top and bottom major surfaces, are provided with cooperating corner grooves which extend for the height of the panel members 22*b*. The panel members are abutted so as to align the cooperating corner grooves or notches 68 and the previously installed and anchored reinforcing by vertical rebars 90, and establish at least a major portion of a mold cavity. The mold cavity in this instance may be completed by straddling the adjacent grooves of the abutting panel members with a temporary form member 70 to complete the mold cavity, then pouring the concrete into the cavity so as to form a concrete column and permanently establish a portion of a wall with the abutting panel members of the concrete column. Or, following attachment of the outer mesh 26 to the appropriately located vertical rebar 90, the cavity formed may be filled with gunite at the same time that surface 22*b* is concreted over mesh 26, binding the entire structure. Alternatively, the panel members 22*b* may be removed and other panel members supplied.

In the embodiment of FIG. 12, cooperating longitudinal grooves 72 are provided in the sides of panel members 22*c* between the top and bottom major surfaces thereof so as to complete the mold cavity for reception of concrete. The cavity will be formed around previously placed and anchored vertical rebars 90, following which the concrete is poured or tremied into the mold cavity. Again it is possible either to leave the panel members 22*c* in place forming a permanent portion of a wall or to remove the panel members 22*c* and utilize other panel members. The rebar should be previously located so that the mesh can be attached prior to the guniting or plastering of the outer vertical wall sections, thereby joining the entire structure when the column and the vertical wall surfaces are gunited.

In the embodiment of FIG. 12*a*, the panel members are not provided with end grooves. Instead the panels are positioned a distance apart equal to the width of the vertical column members and a temporary formwork 70 spans the gap in the rear between the adjacent panels. The rebars 90 are placed in position and the mesh in front of the panels is secured to the reinforcing rebars. The column member is then formed by guniting through the mesh to fill the cavity. After the reinforced concrete hardens, the temporary form member 70 is removed.

Returning now to the illustration in FIG. 8, the reinforced concrete column members 54 illustrated in this figure may be formed by either of the methods illustrated in FIGS. 11 and 12 after which the concrete is poured atop the flat roof or intermediate floor panel members 40*a* at the same time filling the optional longitudinally extending channels 60. The laterally extending channel or conduit 62 flowing into the area designated 64a immediately above columns 54 are filled at the same time, firmly joining the conduit 62 to the columns 54.

FIG. 13 illustrates a core structure 22*d* for a modular panel member which comprises a heat insulating plastic member 24 which is molded with top and bottom major surfaces and which has a rigid strip member 76 embedded therewithin. The rigid strip member 76 is provided with substantially V-shaped corrugations which have ridges substantially coincident with the top major surface of the molded plastic core 24 and troughs which are substantially coincident with the bottom major surface of plastic core 24. To facilitate the foaming of the molded plastic core 24, the rigid strip member 76 may also be provided with a plurality of apertures 77, either randomly or regularly placed. While the reinforcement provided by rigid strip member 76 will prevent bending about one axis, in order to prevent bending at 90 degrees thereto, the rigid strip member 76 is provided with slots 78 at a plurality of locations so as to provide parallel lines of slots which then receive a plurality of tension members 80 thereby inhibiting bending about two plans 90 degrees with respect to each other. While the drawing depicts the deposition of a plurality of tension members 80 in the ridges of the rigid strip member 76, it is also possible to provide a similar set of tension members 80 in the troughs of the rigid strip member 76. Tension members may be rods, wires, fiberglass, or plastic.

FIG. 14 illustrates another core structure for a modular panel member designated 22*e*. In this panel member a heat insulating plastic member 24 is molded with parallel top and bottom major surfaces and a honeycomb member indicated generally at 82 is embedded therewithin. The honeycomb member 82 has cell members which extend between the top and bottom major surfaces of the heat insulating plastic member 24 and an optional frame means 84 may extend around the sides and ends of the core structure, or may be placed within the perimeter of the plastic core rectangle, thereby forming framed openings for doors and windows.

FIGS. 15 and 16 illustrate two preferred building panels for roof structures. In both embodiments a core construction of styrofoam or similar core material is illustrated at 24 and a thin layer of reinforced concrete 64 is applied atop the styrofoam core. In both embodiments a relatively thin tensile member is secured to the bottom of the styrofoam core. In the FIG. 15 embodiment, the relatively thin tensile member is a metal mesh member 46 and in the FIG. 16 embodiment, the relatively thin tensile member is fiberglass. The tensile members may be then covered with plaster or concrete, forming a composite beam type structure.

The panel members of the present invention permit all openings to be either cast in or cut in either before or after the covering operations. Provisions may be made for air conditioning and other duct work including electrical conduit raceways or other devices for inserting electrical cables or the like. The panels may also be ducted for water and sewer connection.

As is generally known, composite structure are employed in many different ways in the construction process. The foregoing deals with a non-conventional application of construction materials, and in particular with the utilization of expanded polystyrene (or polyurethane or similar), which serves not only as a formwork to receive a deck or wall or roof slab, but also serves to cooperate with a concrete or reinforced concrete slab to resist externally applied loads. Finally, the same expanded plastic foam couplies as an insulating thermal material of superior quality.

In the function of cooperating to resist an externally applied load, the material when joined to a reinforced concrete slab which absorbs compressive forces, assists in achieving longer spans than would be the case without the foam.

The resistance of the reinforced concrete slab above would be calculated by the formula:

$$\sigma=(My/I);$$

where $\sigma$=Force

M=Bending moment y=Distance from the neutral axis

I=Moment of inertia with respect to the neutral axis.

In the case of the composite section the same formula would apply, but considering that the upper reinforced concrete section may now be multiplied by a factor n:

$$n=(Ec/Ep)$$

where

Ec=Modulus of elasticity of the concrete

Ep=Modulus of elasticity of the plastic material.

In the particular case of the roof of a building, if the polystyrene thickness is three or five times the thickness of the reinforced concrete roof slab, the factor n will allow much longer clear spans than would be the case without the plastic over which the slab is poured.

The addition of a tension member at the bottom of the slab greatly increases this effect. The tension member could be a steel or plastic mesh located at the bottom of the plastic section, or could be metal, fiberglass, or similar strands applied to the bottom of the plastic, as long as a firm adherance is achieved.

While presently preferred embodiments of the inventions have been illustrated and described, it will be recognized that the invention may be otherwise variously embodied and practiced within the scope of the claims which follow.

I claim:

1. A complete building roof, wall and intermediate floor structure which comprises:

a. a plurality of building panels formed from synthetic material and having opposed major surfaces to provide wall panel members and roof panel members, (1) said building panels being prefabricated and assembled so as to form conduits between adjacent wall panel members and corresponding roof panel members to provide upon setting of pneumatically applied reinforced concrete structure, b. a plurality of vertical, inclined or horizontal reinforced concrete members capable of being joined to said panel members, c. the erected synthetic material which originally form conduits and surfaces to receive the concrete and which together comprise the erected structure revert to insulation following the setting of said concrete and provide no structural support to the completed builiding.

2. A building structure as defined in claim 1 including steel structural elements substituted for some or all of the reinforcing members of said reinforced concrete.

3. A building structures as defined in claim 1 including plastic structural elements substituted for some or all of the reinforcing members of said reinforced concrete.

4. A building structure as defined in claim 1 including metallic mesh members attached to one or more of said opposed major surfaces of said building panels and to appropriate reinforcing members prior to placement of said concrete.

5. A series of structural column and joined continuous beam members in the plane of and/or perpendicular to vertical wall members, and said columns and beam members positioned between and formed by a synthetic material mold structure provided by the placement of abutting building panel members leaving small conduits therebetween, which integral column and beam members are a. anchored to a foundation with said column members positioned by said building panel members, b. formed by concrete which is placed into said conduits provided by said panel members and which conduits contain previously field placed and anchored supplementary reinforcing steel members and into said conduits are placed as required by the structure steel reinforcing members in such combination so as to provide an integral structural solution for walls, intermediate floor slabs, roofs and supports, and c. are completed so as to leave exposed reinforcing steel members to connect to appropriate roof, intermediate, and support beam reinforcing members and slab reinforcing members so as to form an integral structure upon setting of the concrete.

6. In combination, a plurality of panel members for a closed perimeter wall structure and combined roof structure provided with a plurality of reinforced concrete columnar and roof beam members, and a reinforced concrete floor slab, which comprises a. a plurality of notched wall panel members and roof members each formed from synthetic material and being erected on and secured to said reinforced concrete floor slab in closely spaced relationship forming a rigid frame structure or post and beam construction upon setting of the concrete, b. a plurality of reinforced concrete columnar and contiguous beam members filling the notches of said panel members and forming with said panel members a closed perimeter beam wall and roof structure, (1) said perimeter beam joining reinforced columnar members together and providing an interconnection with said reinforced concrete slab through said reinforced columnar members, (2) said perimeter beam forming a continuous support and being joined integrally with roof panels or intermediate floor structures.

7. A combination as defined in claim 6 wherein said wall panel members are formed to provide openings and conduits to accommodate doors, windows, ductwork, switch boxes, and raceways.

8. A combination as defined in claim 6 wherein said wall panel members are reinforced in at least one major surface to accommodate heavier loading conditions.

9. The combination as defined in claim 6 wherein said roof panel members are provided with notches adjacent the lower end of said roof panels to form said perimeter beam in a post and beam structure which is poured together with the column and beam members and forming thereby an integral rigid frame structure.

10. A modular panel structure useful in forming roof structures which comprises:

a. a heat insulating body member having upper and lower surfaces, (1) said body member having a plurality of channel means extending downwardly from and longitudinally of the upper surface of said body member adapted to receive reinforced concrete therein, (2) said body member having at least one laterally extending channel means in fluid communication with said plurality of longitudinally extending channel means, b. a reinforced mesh means affixed to the upper surface of said body member, c. and retaining means to retain a layer of reinforced concrete on top of said upper surface of said body member.

11. A modular panel structure as defined in claim 10 wherein said retaining means comprises an elevated lip member extending above said upper surface of said body member along the peripheral edge of at least three sides of said body member.

12. A modular panel structure as defined in claim 10 wherein said body member tapers inwardly as said panel structure approaches an apex of said roof structure.

13. A modular panel structure as defined in claim 10 wherein said body member is provided with laterally extending channel means at opposite longitudinal ends of said body member, each of said laterally extending channel means being in fluid communication with said plurality of longitudinally extending channel means.

14. A building structure made essentially from a plurality of prefabricated panels which comprises:

a. a series of spaced, vertically disposed reinforced concrete column members, b. a set of wall panel members having outer and inner wall surfaces, (1) said set of wall panel members being formed from a heat insulating material and having mesh members secured to either of said outer and inner wall surfaces and to said column members, and c. a set of roof panel members forming a roof structure supported and affixed to the top of said series of column members and said set of panel members, (1) said wall panel members providing a structural space between the sides of adjacent wall panel members, (2) said roof and intermediate floor panel members being configured similar to said wall panel members including mesh members and defining a structural space between adjacent roof and intermediate floor panel members with cut holes in each substantially coinciding with said structural space between the sides of adjacent wall panel members to permit concreting of field connected reinforcing steel placed following panel erection, (3) said structural spaces being filled with concrete, with rebar having been previously placed therein, to establish said reinforced concrete column members and a unitary structure between said roof, intermediate floor and wall panel members.

15. A building structure as defined in claim 14 wherein said wall panel members have longitudinally extending groove means molded in the upper wall portion thereof which groove means intersect said structural space between the sides of adjacent wall panel members permitting horizontal steel reinforcing members in said groove means to be connected to steel reinforcing members in said structural space and establish a perimeter beam with reinforced concrete disposed in said groove means integrally connected to said vertically disposed column members.

16. A building structure as defined in claim 14 wherein beam members placed atop said wall panel members establish a perimeter beam to facilitate one or more interemediate floor members, said intermediate floors being formed from panel members similar to said wall and roof panels, and said intermediate floor panel members having apertures coinciding with said structural spaces in said wall panel members to facilitate a unitary structure when said poured concrete has set.

* * * * *